US005267370A

United States Patent [19]

Wörwag

[11] Patent Number: 5,267,370

[45] Date of Patent: Dec. 7, 1993

[54] SUCTION DEVICE FOR LIQUIDS

[75] Inventor: Peter Wörwag, Romanshorn, Switzerland

[73] Assignee: Firma Fedag, Romanshorn, Switzerland

[21] Appl. No.: 695,292

[22] Filed: May 3, 1991

[30] Foreign Application Priority Data

May 5, 1990 [DE] Fed. Rep. of Germany ..... 4014443

[51] Int. Cl.[5] ..... A47L 9/28

[52] U.S. Cl. ..... 15/319; 15/339; 15/353; 55/216

[58] Field of Search ..... 15/353, 319, 339; 55/215, 216

[56] References Cited

U.S. PATENT DOCUMENTS 3,286,444 11/1966 Boswinkle et al. ..... 55/215

4,207,649 6/1980 Bates ..... 15/321 X

*Primary Examiner*—Chris K. Moore

*Attorney, Agent, or Firm*—Robert W. Becker & Associates

[57] ABSTRACT

Known suction devices for liquids are provided with a motor-driven suction fan, that introduces an air/liquid flow via a suction nozzle into a liquid receptacle in which the liquid is separated and collected. In order to avoid introduction of liquid into the motor-driven suction fan a device for monitoring the level of liquid in the receptacle is provided which, when a maximum filling level is reached, activates an emptying display. In order to achieve an exact determination of the filling level of the receptacle; it is suggested to provide the monitoring device in the form of a light barrier.

20 Claims, 4 Drawing Sheets

SUCTION DEVICE FOR LIQUIDS

BACKGROUND OF THE INVENTION

The present invention relates to a suction device for liquids having a motor-driven suction fan and introducing an air/liquid flow via a suction nozzle into a liquid receptacle in which the liquid is collected, and having a means for monitoring the level of liquid in the liquid receptacle in order to avoid introduction of liquid into the motor-driven suction fan, and having a display that is activated when the maximum filling level is reached.

Suction devices for liquids serve to receive cleaning liquids that have been put onto soiled floor surfaces for cleaning purposes. The liquid is sucked up by a suction air flow via a suction line having attached thereto a suction tool and is collected in the receptacle. The interior of the receptacle is in a direct flow connection with the motor-driven suction fan. In order to avoid introduction of liquid into the motor-driven suction fan the level of liquid collected in the receptacle must be monitored and must be limited to a maximum filling level.

With known suction devices a float gauge is arranged within the liquid receptacle in the flow path to the suction fan. With the rising liquid level the float gauge is moved towards the suction opening of the suction fan and when the maximum filling level is reached the opening is closed. Since no suction is observed at the suction tool and the noise level is changing due to the corresponding increase in revolving speed of the motor-driven suction fan, the operating personnel of the suction device are thus made aware that the liquid receptacle must be emptied.

In another known suction device the electric conductivity of the sucked-in dirt water between two insulated sensors is used to determine the filling level. The flowing electric measuring current is introduced into a signal processing unit and is therein processed to shut off the motor-driven suction fan and activate a display unit.

The known suction devices for liquids have the disadvantage that the surface of the liquid is exposed to the suction flow in the receptacle which results in a strong wave-like motion. Furthermore, a strong foaming of the dirt water containing detergents is observed. Both effects result in an unsatisfactory determination of the filling level due to the wave-like motion. The suction device for liquids often will shut off even though the maximum filling level has not been reached, thereby causing unnecessary operational shut-down periods.

It is therefore an object of the present invention to provide a suction device for liquids of the aforementioned kind with which an exact filling level of the dirt water in the receptacle can be determined while at the same time, the introduction of suds or liquids into the motor-driven suction fan is safely prevented.

SUMMARY OF THE INVENTION

The suction device for liquids of the present invention is characterized by having a means for monitoring in the form of at least one reflection light barrier that has coordinated thereto a reflector means.

With the light barrier that is aimed at the liquid level the filling level may be monitored in a simple manner. It is advantageous that the light barrier is provided in the form of a reflection light barrier which has coordinated thereto a reflector at the maximum filling level of the receptacle. This reflector is fastened to the inner wall of the receptacle, and when the liquid level surpasses the maximum filling level, it is flooded by the dirt water. Thereby the reflection properties of the reflector are reduced so that the light beam emitted by the emitter of the light barrier is not reflected or is reflected to a limited extent. The receiver records the strongly reduced intensity or the missing of the reflected light beam and emits a respective initial signal which is advantageously used for controlling an emptying display and for shutting off the motor-driven suction fan.

In a preferred embodiment of the present invention the light barrier is optically coupled to an end of a light-conducting rod, the other end of which functions as a retro reflector and extends axially into the receptacle to the maximum filling level. The emitted light beam is reflected to the receiver at the preferably semi-spherical head of the free end of the rod and is then processed. When the dirt water floods the free end of the rod, its reflection properties are changed and the light beam emitted by the emitter is not or only partially reflected to the receiver. The respectively changed signal of the receiver is used as the initial signal of the receiver to control the display and the shut-off of the motor-driven suction fan.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 6.

Figure 1:
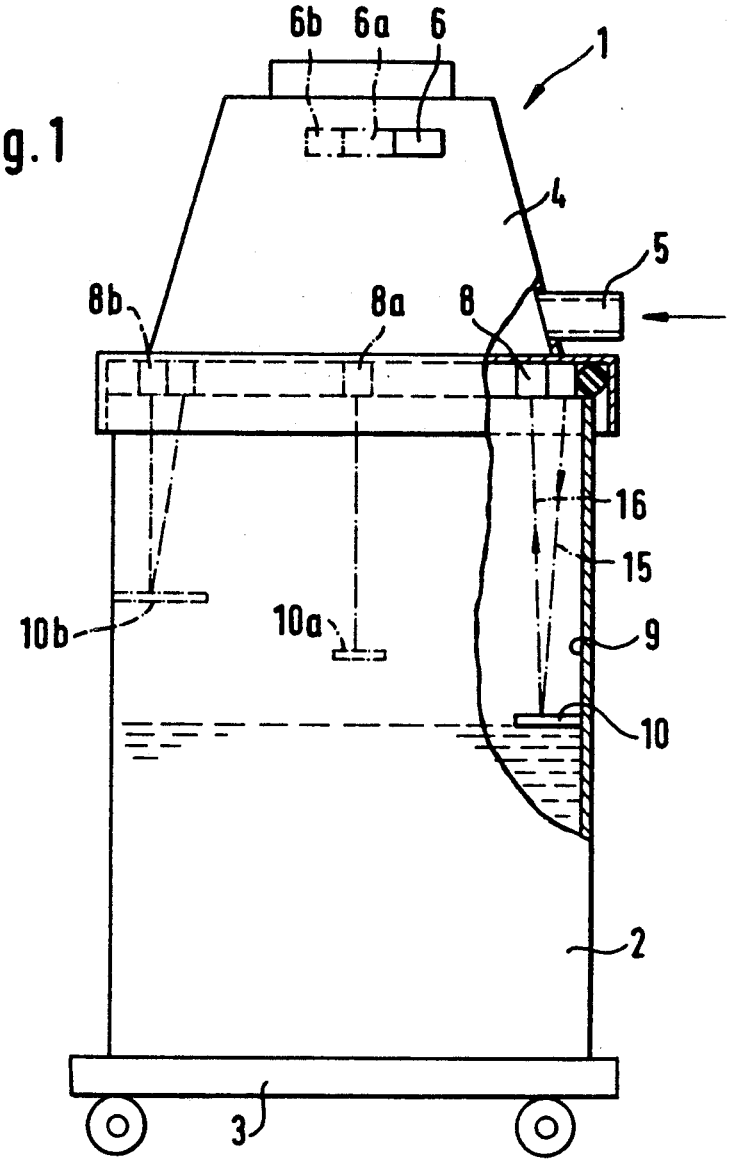
FIG. 1 is a schematic representation of a longitudinal cross section of a suction device for liquids.

The suction device for liquids 1 represented in FIG. 1 comprises essentially a liquid receptacle 2 which is disposed on a drive support 3. The cup-shaped receptacle 2 is sealed off in an air tight manner by a cover 4, whereby a motor-driven suction fan that is not represented in the drawing as well as electronic circuitry and a display 6 are integrated in the cover 4. The cover 4 is also provided with a suction nozzle 5 which is connected via a non-represented suction line to a non-represented suction tool. On the inner side of the cover 4 which is facing the interior of the receptacle 2 a light barrier 8 is disposed which emits a light beam that is axially directed into the receptacle 2 and. spaoed at a small distance, extends essentially parallel to the inner wall 9 of the receptacle 2. In the shown embodiment the light barrier 8 is a reflection light barrier. The emitted light beam 15 is reflected at a reflector 10 and is returned as a reflected Light beam 16 to the receiver of the light barrier 8. The receiver is arranged at a close distance to the emitter, preferably both are integrated in a common protective housing.

Figure 3:
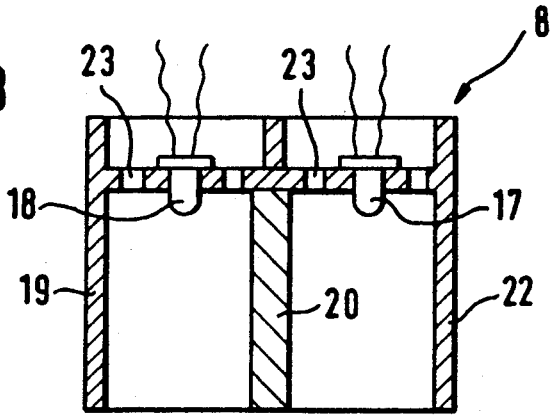
FIG. 3 shows a cross section of a reflection light barrier having a protective housing and air inlet openings.

During operation of the suction device for liquids 1 the motor-driven suction fan creates a suction air flow with a flow path from the suction tool via the suction line, the suction nozzle 5, the interior of the liquid receptacle 2 to the motor-driven suction fan. Liquid that has been sucked in is separated in the receptacle 2 whereby the level of liquid is rising correspondingly during operation. In the empty state and during the initial filling of the receptacle for liquids 2 the light beam 15 which is emitted by the emitter 17 (FIG. 3) of the light barrier 8 is reflected at the reflector 10 and is returned to the receiver 18 as a reflected light beam 16 (FIG. 3). The signal generated in the receiver is processed in an electronic processing unit which initially activates the motor-driven suction fan in order to begin operation. When a reflected light beam 16 is received, the receiver will simply activate a switch (transistor etc.) for a first operational state in which the motor-driven suction fan is switched on and the display 6 is turned off. When the reflected light beam 16 reaches the receiver with a reduced intensity, the receiver, when the intensity falls below a certain limit, will change the switching state so that the motor-driven suction fan is shut off and the display 6 is activated. When the liquid collected in the receptacle reaches the maximum filling level the reflector 10 is flooded by the dirty water. Thereby the reflection properties are changed so that the incident light beam 15 is reduced in its intensity or is not reflected at all. The missing light beam respectively the light beam 16 with reduced intensity results in a signal change within the receiver. This signal change is processed in the electronic data processing unit and results in a shut-off of the motor-driven suction fan and in an activation of the display 6 which will show the required emptying of the receptacle for liquids.

Figure 2:
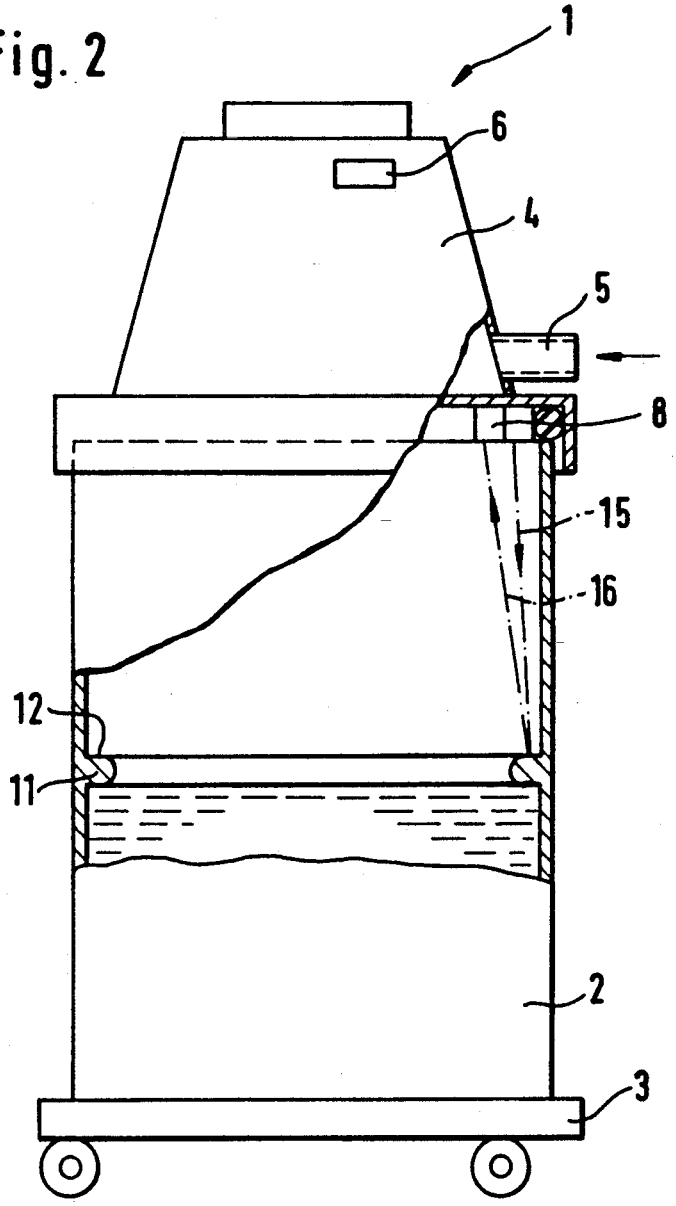
FIG. 2 is a schematic representation of a longitudinal cross section of a suction device for liquids having an annular projection edge inside the receptacle for liquids.

As can be seen in FIG. 2 the reflector 10 may be provided at the inner wall 9 of the liquid receptacle in the form of an annular projection edge 11 which is preferably an integral part of the receptacle 2. The annular projection edge 11 is provided with a horizontal surface 12 which is facing the opening of the receptacle 2 and is embodied as a retro reflection surface for the emitted light beam 15 of the light barrier 8. A reflection surface that extends over the inner circumference of the receptacle 2 is advantageous since a defined rotational position of the cover 4 with respect to the vertical axis is not required. With every rotational position of the cover 4 the light barrier 8 is disposed opposite a reflection surface. It is advantageous to use the area of the reflection surface that is in the vicinity of the suction nozzle opening since this reflection surface is easily kept free of suds due to the incoming air flow. Operational failures of the light barrier 8 due to suds in the area of the reflection surface are thus essentially prevented.

As can be seen from FIG. 3 the light barrier 8 is arranged in a common housing. In order to avoid malfunctions between the emitter 17 and the receiver 18 and to keep suds and other materials away, the emitter 17 and the receiver 18 are separated from one another by covering sleeves 19, 22. At the bottom of the housing 20 flow openings 23 are provided, preferably surrounding the receiver and the emitter, through which, via air inlet openings at the cover, a small blowing air flow of surrounding air is introduced so that suds and dirt particles are blown away thereby increasing the functional safety of the device. Since the interior of the receptacle 2 is under vacuum the blowing air flow is achieved without further technical measures.

In a further embodiment of the present invention a plurality of reflectors 10, 10*a*, 10*b* (FIG. 1) are preferably provided at different levels within the receptacle 2 whereby each reflector 10, 10*a*, 10*b* has coordinated thereto an individual light barrier 8, 8*a*, 8*b*. Each of the reflection light barriers 8, 8*a*, 8*b* is connected via the electronic data processing unit with a respective display 6, 6*a*, 6*b* and switched such that during operation the various filling levels are subsequently indicated by the displays 6, 6*a*, 6*b*. The operating personnel are thereby exactly informed of the actual filling level of the receptacle 2.

Figure 5:
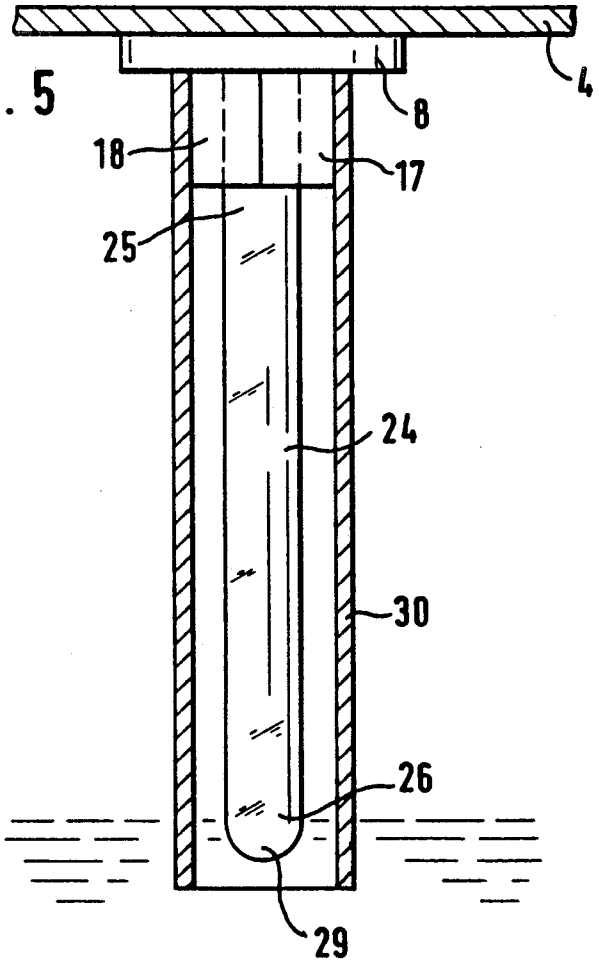
FIG. 5 is a partial cross section of a reflection rod provided with a protective tube.
Figure 4:
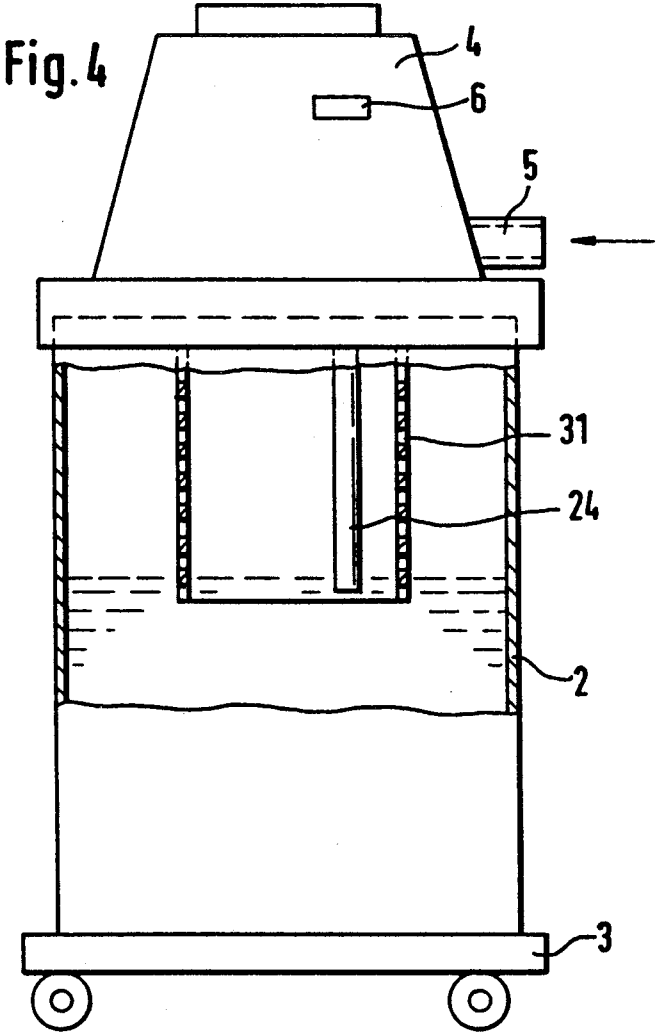
FIG. 4 is a schematic representation of a cross section of a suction device for liquids with a reflection rod extending axially into the liquid receptacle.

A further embodiment of the present invention is represented in FIGS. 4 and 5. As can be seen from the schematic cross-section in FIG. 4, a reflection rod 24 is attached to the cover 4 which extends axially into the interior of the liquid receptacle 2. The reflection rod 24 is preferably made of a transparent material such as glass or plastic. The free end 26 of the rod 24 is positioned approximately at the level of the maximum allowed liquid level. A reflection light barrier 8 with its emitter 17 and its receiver 18 is attached to the end 25 of the transparent rod 24 that is adjacent to the cover 4 and is optically coupled to the transparent rod 24 (FIG. 5). The light beam emitted by the emitter 17 is reflected at the end surface of the free end 26 of the rod 24 and is reflected as a reflected light beam to the receiver 18. When the free end 26 of the rod 24 is flooded by the liquid rising inside the liquid receptacle 2 the emitted light beam is deflected at the interface between the rod surface at the end of the rod and the surrounding water such that no reflection of the light beam to the receiver 18 occurs. The initial signal of the receiver 18 is thus changed which is in return recognized by the electronic data processing unit and the display 6 respectively a switching device is accordingly activated. The suction device is preferably shut off simultaneously with displaying the necessary emptying of the liquid receptacle 2.

In order to increase the signal threshold at the beginning of the flooding the free rod end 26 is preferably embodied in the form of a spherical head 29.

The refractive index of the transparent rod 24 at its interface to air must be higher than the refractive index of air so that a total reflection is approximately achieved and the emitted light beam is reflected entirely to the receiver 18. When the refractive index of the transparent rod material is approximately as great as that of the water around the free end of the rod the limiting angle is approximately 90°. This means that the light beam to be reflected is lost and that no light beam is received at the receiver.

For the protection of the reflection rod 24 attached to the cover 4 the reflection rod 24 is arranged in a protective tube 30. The protective tube 30 prevents disruptive light reflexes on the transparent rod 24. The inner diameter of the protective tube 30 is greater than the outer diameter of the transparent rod 24. Thereby capillary effects of the water and the suds do not have any effects. Air flows into the housing 20 via inlet openings 23 that are arranged at the housing 20 of the light barrier thereby keeping the annular groove between the rod 24 and the protective tube 30 and the rod 24 itself free of suds particles and dirt particles. Preferably, a protective enclosure 31 is also attached to the cover 4 whereby the protective enclosure 31 receives the reflection rod and protects the rod 24 against mechanical damages when the cover 4 is removed from the liquid receptacle 2. The protective enclosure 31 may consist of an open wire mesh or any other mesh material having a plurality of openings in its walls.

Figure 6:
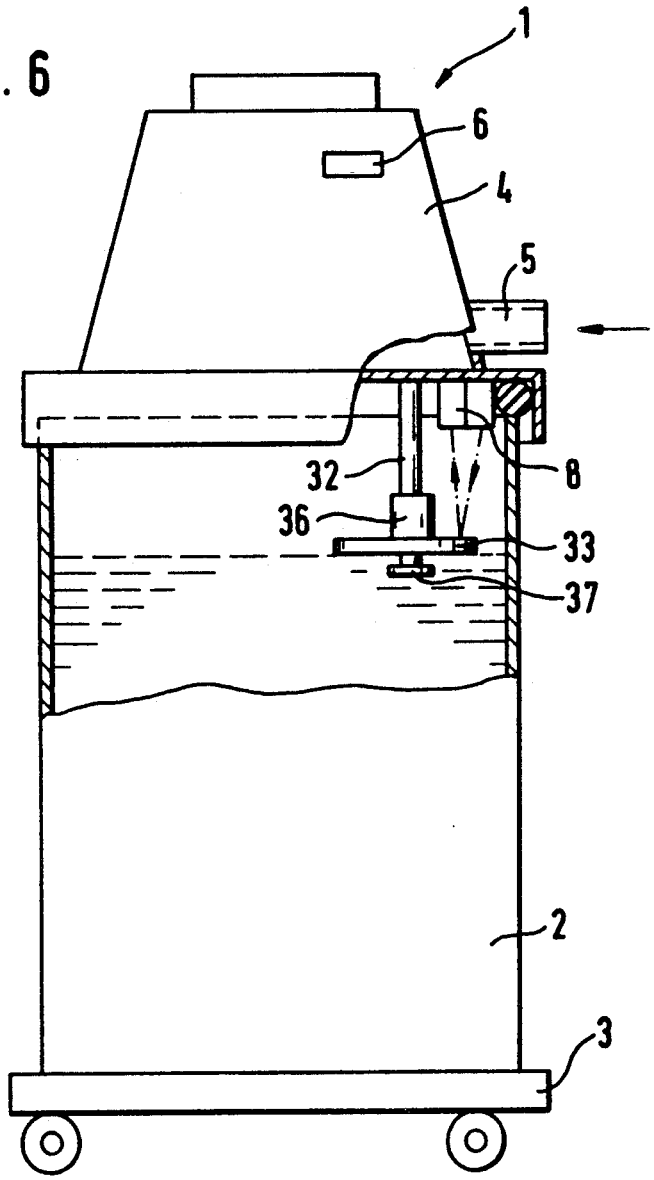
FIG. 6 shows a further embodiment of a suction device for liquids in a cross sectional schematic representation.

In a further embodiment of the present invention shown in FIG. 6 a guide rod 32 is attached to the cover 4 and extends axially into the liquid receptacle 2. A flood gauge 33 is attached to the guide rod 32 and is slidably supported at a guide sleeve 36. In its lowest position it contacts an abutment plate 37. A reflection light barrier 8 is arranged at the cover 4 such that the emitted light beam coming from the emitter 17 reaches the surface of the flood gauge 33 that is facing the light barrier. This surface is in the form of a reflection surface and reflects the incident light beam to the receiver 18 of the light barrier 8. With an increasing filling level of the liquid receptacle 2 due to the inflowing liquid the flood gauge S3 is moved in an axially upward direction by the liquid towards the cover 4 and the light barrier 8. Guided by the guide rod 32 the flood gauge 33 remains in a horizontal position even though the incoming liquid may perform wave-like movements at the surface of the liquid so that the light beam between the emitter 17 and the receiver 18 of the light barrier 8 is reflected without disturbances. The distance between the flood gauge 33 and the light barrier 8 is reduced due to the increasing filling level of the liquid. Since the shortened distance is also accompanied by an intensity increase of the reflected light beam a respective limit may be set in a simple manner and when this limit is surpassed, the data processing unit will switch such that the display 6 is activated and the motor-driven suction fan is shut off.

A restart of the motor-driven suction fan after the maximum filling level has been reached and the suction fan has been shut off is preferably only possible after disengaging a so-called restart lock.

In a preferable embodiment of the present invention the light beam of the light barrier 8 is within the infrared band.

In order to avoid a shut-off of the motor-driven suction fan due to an occasional flooding of the reflector at a low filling level, which will result in a false display. It is desirable that the initial signal of the receiver of the light barrier is only to be processed when the signal has been present over a certain time interval. The time interval is chosen such that occasional wave-like movements will not result in a response of the electronic data processing unit.

In the presented embodiments the light barrier 8 is embodied as a reflection light barrier. Such a light barrier is especially suited because all electronic parts may be arranged at the removable cover 4 so that plug connections can be avoided. It is, however, also possible to employ a forked light barrier in which the emitter is, for example, arranged at the cover 4 and the receiver, for example, is attached to the inner wall of the receptacle 2. Then, only one electric contact between the receiver and the data processing unit at the cover via a plug connection must be provided The present invention is, of course, in no way restricted to the specific disclosure of the specification and drawings, but also encompasses any modifications within the scope of the appended claims.

What I claim is:

1. In a suction device for liquids having a motor-driven suction fan that introduces an air/liquid flow via a suction nozzle into a liquid receptacle in which liquid is collected, and having a means for monitoring a level of liquid in said liquid receptacle in order to avoid introduction of liquid into said motor-driven suction fan, and having a display that is actuated when a maximum filling level is reached, the improvement wherein:

said means for monitoring is in the form of at least one reflection light barrier comprising an emitter for emitting light and a receiver and having a reflector means coordinated therewith for reflecting light emitted by said emitter to said receiver.

2. A suction device for liquids according to claim 1, in which said reflector means is arranged at a height of said maximum filling level and is fastened to an inner wall 9 of said liquid receptacle 2.

3. A suction device for liquids according to claim 2, in which a plurality of said reflection light barriers is provided, with corresponding ones of said reflector means arranged over an inner circumference of said liquid receptacle spaced from one another and at various heights relative to a bottom of said liquid receptacle.

4. A suction device for liquids according to claim 2, in which said reflector means is in the form of an annular projecting edge that is disposed at an inner wall of said liquid receptacle, extends radially into the interior of said liquid receptacle, and has an annular reflection surface facing said light barrier.

5. A suction device for liquids according to claim 4, in which said annular projecting edge is an integral part of said liquid receptacle.

6. A suction device for liquids according to claim 2, in which said reflector means and said light barrier are arranged in the area of an incoming suction air stream.

7. A suction device for liquids according to claim 2, in which said emitter and said receiver of said light barrier are each arranged inside a respective covering sleeve of a common housing, whereby in a bottom area of said housing, in the vicinity of said emitter and said receiver, air inlet openings are disposed that are in a flow connection with the surrounding air.

8. In a suction device for liquids according to claim 1, in which said reflection light barrier is optically coupled with an end of a light-reflecting rod consisting of a transparent material, with a free end of said rod being in the form of a semi-sphere and serving as said reflector means, whereby said rod extends axially into said liquid receptacle and said free end of said rod is disposed at a

9. A suction device for liquids according to claim 8, in which a reflective index of a material of said rod is greater than a reflective index of air surrounding said rod so that a surface of said rod, being an interface to surrounding air, serves as said reflector means.

10. A suction device for liquids according to claim 8, in which a reflective index of a material of said rod corresponds approximately to the reflective index of water, so that a surface of said rod, being an interface to surrounding water, reflects a light beam at approximately 90° .

11. A suction device for liquids according to claim 8, in which said rod is surrounded by a protective tube having an inner diameter that is greater than an outer diameter of said rod.

12. A suction device for liquids according to claim 11 in which a length of said protective tube corresponds approximately to a length of said rod.

13. A suction device for liquids according to claim 11, in which air flows through an annular space between said outer diameter of said rod and said inner diameter of said protective tube.

14. A suction device for liquids according to claim 8, in which said rod is made of mineral glass.

15. A suction device for liquids according to claim 8, in which said rod is made of a transparent plastic material.

16. A suction device for liquids according to claim 8, in which said rod is fastened to a cover of said suction device within a protective enclosure.

17. A suction device for liquids according to claim 1, in which said reflector means is in the form of a float gauge being supported in a slidable manner via a guide sleeve at a guide rod that is attached at a cover of said suction device and extends axially into said liquid receptacle, with a surface of said float gauge that is facing said cover being provided in the form of a reflector for said light barrier.

18. A suction device for liquids according to claim in which said light barrier is attached to said cover and is facing the interior of said liquid receptacle.

19. A suction device for liquids according to claim 1, in which a radiation of said light barrier is within the infrared band.

20. A suction device for liquids according to claim 1, in which a signal emitted by said light barrier is processed in a data processing unit only when it is received for a preset minimum time span.

* * * * *